US006600886B2

(12) United States Patent
Tsukida et al.

(10) Patent No.: US 6,600,886 B2
(45) Date of Patent: Jul. 29, 2003

(54) IMAGE FORMING APPARATUS COMPRISING MEMBER TO BE CHARGED AND A CHARGE MEMBER

(75) Inventors: Shinichi Tsukida, Saitama (JP); Gaku Konishi, Kashiwa (JP); Nobuo Komiya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,585

(22) Filed: Aug. 28, 2001

(65) Prior Publication Data

US 2002/0041776 A1 Apr. 11, 2002

(30) Foreign Application Priority Data

Aug. 29, 2000 (JP) ..... 2000-259624

(51) Int. Cl.[7] ..... G03G 15/00; G03G 15/02
(52) U.S. Cl. ..... 399/167; 399/174; 399/176
(58) Field of Search ..... 399/159, 167, 399/174–176

(56) References Cited

U.S. PATENT DOCUMENTS 5,852,758 A * 12/1998 Wibbels ..... 399/176
5,903,803 A 5/1999 Kawai et al.
6,385,420 B1 * 5/2002 Morioka ..... 399/174

FOREIGN PATENT DOCUMENTS

JP 4-213474 8/1992

* cited by examiner

*Primary Examiner*—William J. Royer
(74) *Attorney, Agent, or Firm*—Fitzpatrick, Cella, Harper & Scinto

(57) ABSTRACT

An image forming apparatus includes a rotatable member to be charged; a rotatable charge member for electrically charging the member to be charged, the charge member being contactable to the member to be charged; and a moving element for moving the member to be charged and the charge member in a longitudinal direction of the member to be charged.

21 Claims, 4 Drawing Sheets

IMAGE FORMING APPARATUS COMPRISING MEMBER TO BE CHARGED AND A CHARGE MEMBER

FIELD OF THE INVENTION AND RELATED ART

The present invention relates to an image forming apparatus and a process cartridge, and more particularly to an image forming apparatus provided with a rotatable contact charging member and a process cartridge provided with the same. Here, the image forming apparatus is an apparatus for forming images on recording materials using an electrophotographic image formation type process, for example. Examples of the electrophotographic image forming apparatus include an electrophotographic copying machine, an electrophotographic printer (a laser beam printer, a LED printer or the like), a facsimile machine, a word processor and the like.

Here, the process cartridge is a cartridge containing as a unit at least a member to be charged (image bearing member) and a charge member, the cartridge being detachably mountable to the main assembly of the image forming apparatus.

In the field of an electrophotographic type image forming apparatus, a so-called contact-type charging means is known in which a charge member directly contacts the surface of the member to be charged to electrically charge the surface of the member to be charged, such as an electrophotographic photosensitive member.

Referring to FIG. 8, there is shown an image forming apparatus using a contact-type charging means, in the form of a laser beam printer. The printer comprises an electrophotographic photosensitive member having an organic photosensitive layer (photosensitive drum) 101 (member to be charged) driven at a predetermined process speed in the direction indicated by an arrow. The photosensitive drum is uniformly charged by the contact-type charging means in the form of a charging roller 102.

Subsequently, the photosensitive drum 101 is exposed to scanning image light by a laser beam 103 which has been ON/OFF-controlled in accordance with image information, so that an electrostatic latent image is formed on the photosensitive drum 101. The electrostatic latent image is developed or visualized into a toner image by developing means 104 disposed opposed to the photosensitive drum 101. The developing means 104 comprises a developer carrying member in the form of a developing sleeve 104*a* rotationally driven in the direction indicated by an arrow, and the developing means 104 contains toner 104*b* which is charged to a negative polarity. The developing method is a jumping developing method, for example, and reverse development is used in which the exposed portion of the image receives the toner.

The visualized toner image is transferred onto a surface of a transfer material P (recording material) fed at predetermined timing at a transfer station 106 which is constituted by the photosensitive drum 101 and a transfer roller 105 press-contacted to the photosensitive drum 101 and rotated. The transfer material P is then fed to fixing means 107 where the toner image is fixed into a permanent image, and the transfer material P is discharged to the outside of the apparatus.

A slight amount of untransferred residual toner remaining on the surface of the photosensitive drum 101 after the completion of the transfer step, is removed by cleaning means 108. The cleaning means 108 is in the form of a cleaning blade 108*a*, which is an elastic member made of urethane rubber contacted counterdirectionally to the surface of the photosensitive drum 101.

The photosensitive drum 101 will be described. The photosensitive drum 101 comprises a cylinder made of aluminum or the like, an organic photosensitive layer on an outer surface thereof and a drive transmitting means at one longitudinal end portion of the cylinder. The drive transmitting means may be in the form of a substantially triangular-prism-like twisted projection (coupling member) of a resin material provided at the central portion of the end of the photosensitive drum (U.S. Pat. No. 5,903,803). The projection is engageable with a substantially triangular shaped twisted hole provided at the central portion of a gear, which is driven by a motor provided in the image forming apparatus. Alternatively, the drive transmitting means may be in the form of helical gears or the like. By using such a drive transmitting means, the photosensitive drum driving can be stabilized as compared with a driving means using conventional spur gears, thereby decreasing the occurrences of non-uniformity in the pitches in resultant images, and therefore, the image quality in half-tone images is improved.

The charging roller 102 will be described in detail. The charging roller 102 comprises an electroconductive metal core, an elastic layer on the outer surface of the electroconductive metal core, a resistance layer on the outer surface thereof, and a protection layer on the outer surface thereof, for example. The opposite end portions of the metal core are supported by bearings, which are urged toward the photosensitive drum 101 by respective springs, by which the charging roller 102 is press-contacted to the photosensitive drum 101. The charging roller 102 is supplied with an oscillating voltage including an AC component and a DC component superimposed thereon from a high voltage source through a contact, a spring, a bearing, a metal core and the like, by which the surface of the photosensitive drum 101 is electrically charged to a predetermined potential.

The bearings are made of a plastic resin material. At least one of the bearings at the side supplied with the electric power, is dispersed with carbon fiber or the like in the plastic resin material during the molding, so that its resistance value is $10^3$–$10^4$ΩpScm (electroconductive).

It is known that a skewed arrangement of the contact-type charging means is known in which the rotation shaft of the photosensitive drum and the rotation shaft of the charging roller are not parallel, that is, they form a crossing angle (Japanese Laid-open Patent Application 4-213474). The main purpose of the skewed arrangement is to make uniform the contact pressure of the charging roller relative to the surface of the photosensitive drum along the longitudinal direction and to make the position of the charging roller constant along the longitudinal direction.

As regards the latter purpose, further downsizing of the main assembly of the laser beam printer or the like is desired because of the recent tendency of personal use. In view of such desire, when the maximum width of the usable sheets is 216 mm, for example, the length (width) of the charging roller is as small as approximately 220 mm, for example. However, in such a case, if the position of the charging roller relative to the maximum width is deviated, improper charging occurs at either one of longitudinal end portions with the result of fog production or sheet-edge contamination due to the improper charging adjacent the corresponding lateral end of the recording material. By the skewed arrangement of the photosensitive drum and the charging roller, the charging roller is subjected to a thrust force in the longitudinal direction to a predetermined position, so the above-discussed problem can be avoided.

Here, it is desirable to minimize the length of the photosensitive drum as well as the length of the charging roller so that the main assembly of the apparatus and the process cartridge can be shortened.

It is also desired that the time period required for the charging roller to move to a predetermined position (longitudinal direction) is shortened. If the required time period is long, the charging roller is unable to move to the predetermined position prior to the start of an image formation process responsive to the instructions from a host computer or the like to the image forming apparatus, with a result of the above-described production of fog and/or the sheet-edge contamination. With the recent trend for a shortened first print time, the problem becomes significant.

SUMMARY OF THE INVENTION

Accordingly, it is a principal object of the present invention to provide a process cartridge and an image forming apparatus in which the lengths of the charge member and the member to be charged are minimized. It is another object of the present invention to provide a process cartridge and an image forming apparatus in which the lengths of the main assembly of the image forming apparatus and the process cartridge are shortened. It is a further object of the present invention to provide a process cartridge and an image forming apparatus in which the time required for the charge member to move to a predetermined position in the longitudinal direction can be shortened.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A description will be provided as to the image forming apparatus and the process cartridge according to an embodiment of the present invention.

Embodiment 1

Referring to FIGS. 1–7, a first embodiment of the present invention will be described.

Figure 1:
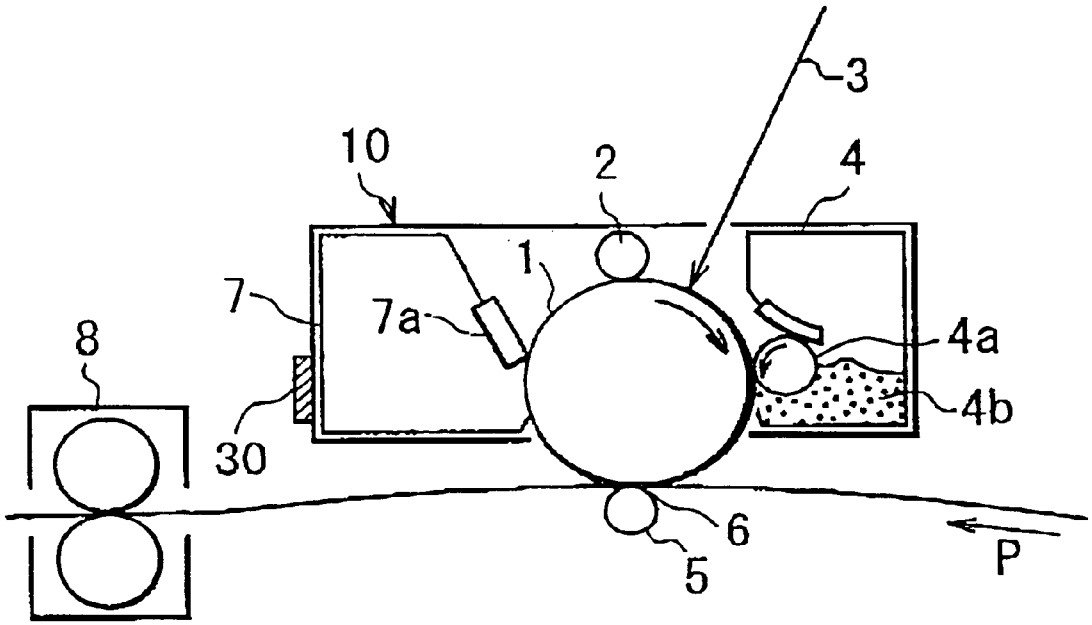
FIG. 1 is a schematic view of an image forming apparatus according to an embodiment of the present invention.

As shown in FIG. 1, the image forming apparatus of this embodiment comprises an electrophotographic photosensitive member (member to be charged) in the form of a photosensitive drum 1, and the photosensitive drum 1 includes a base in the form of an aluminum cylinder or the like and a photosensitive material such as OPC on the outer surface thereof. The outer diameter thereof is 30 mm. The photosensitive drum 1 is rotated in the direction indicated by the arrow at a peripheral speed of approximately 50 mm, and the surface thereof is uniformly charged by a charging roller 2 to approximately −550 V (dark portion potential VD). The charging roller 2 is supplied with an oscillating voltage comprising a DC voltage of −560 V and an AC voltage of 2200 V (peak to-peak voltage) having a frequency of 350 Hz, for example.

Then, the photosensitive member is exposed to image light by a laser beam 3 subjected to ON/OFF-control in accordance with image information, so that an electrostatic latent image is formed with a light portion potential VL of approximately −120 V. The electrostatic latent image thus formed is developed or visualized into a toner image by a developing device 4 (developing means) disposed opposed to the photosensitive drum 1.

The developing device 4 comprises a developer carrying member in the form of a developing sleeve 4*a* which is rotated in the direction indicated by the arrow, and it contains a developer (toner) 4*b* which is charged to a negative polarity. The developing sleeve 4*a* is supplied with a developing bias which is an oscillating voltage comprising a DC voltage component of −350 V, for example and an AC voltage component of 1800 V (peak-to-peak voltage) having a frequency of 2000 Hz. The developing method is a so-called jumping developing method for example, and reverse development is used in which the exposed portion receives the developer.

The visualized toner image on the photosensitive drum 1 is transferred onto a surface of a transfer material P (recording material) fed at a predetermined timing to a transfer station 6, which is constituted by the photosensitive drum 1 and a transfer roller 5 press-contacted to the photosensitive drum 1 and rotated, while the transfer roller 5 is supplied with a voltage (transfer bias) of a polarity opposite from that of the regular charge polarity of the toner 4*b*.

The transfer roller 5 comprises a metal core of metal such as SUS (stainless steel) and foam rubber comprising epichlorohydrin rubber in which electroconductive material is dispersed, for example. The outer diameter is 16 mm in this embodiment.

A slight amount of untransferred residual toner remains on the surface of the photosensitive drum 1 after the completion of the transfer step, and is removed by a cleaning device 7. The cleaning device 7 is provided with a cleaning blade 7*a* having an elastic member of urethane rubber or the like at an end portion of a supporting member of a metal plate. The free end portion of the elastic member contacts the surface of the photosensitive drum 1 counterdirectionally with a predetermined pressure so as to remove the untransferred residual toner from surface of the photosensitive drum 1.

Thereafter, the transfer material P is transported to the fixing device 8, where the image is fixed into a permanent image. The transfer material P is then discharged to outside of the apparatus.

In this embodiment, the photosensitive drum 1, the charging roller 2, the developing device 4 and the cleaning device 7 constitute a unified process cartridge 10, and the process cartridge 10 is detachably mountable to the main assembly of the image forming apparatus through mounting means 30.

Figure 2:
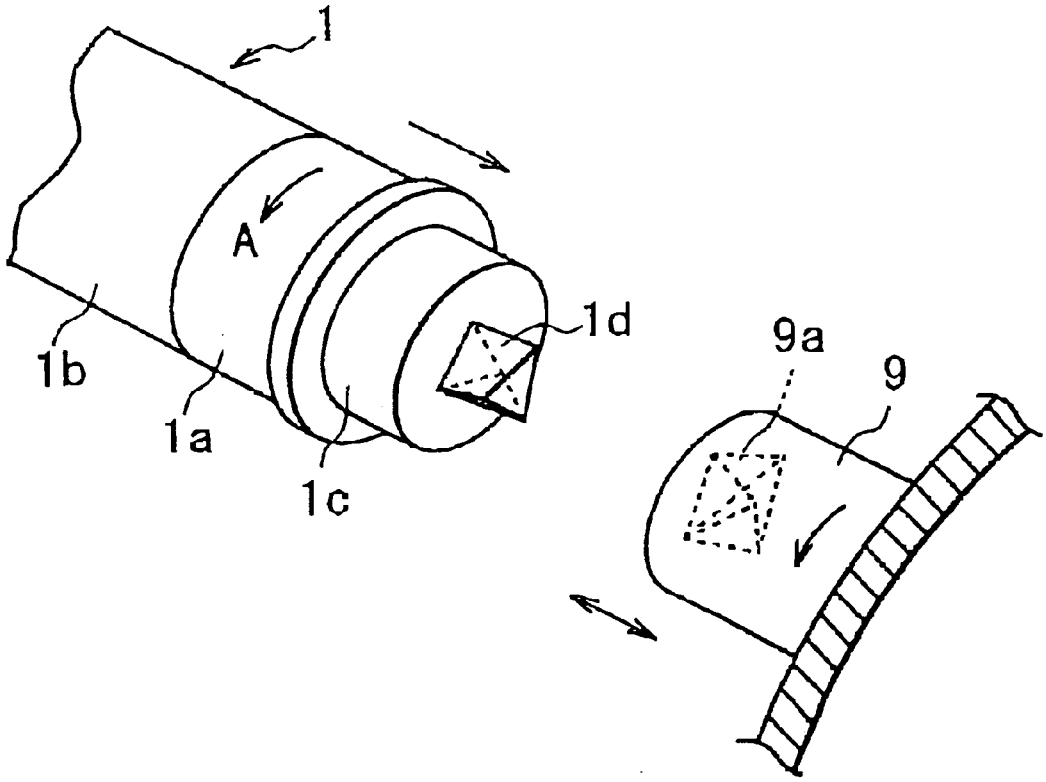
FIG. 2 is an illustration of a photosensitive drum according to an embodiment of the present invention.

Referring to FIG. 2, the photosensitive drum 1 will be described in detail.

The photosensitive drum 1 comprises a cylinder 1*a* of aluminum or the like, an organic photosensitive layer 1*b* on the outer surface thereof, and a coupling member 1*c* (driving force receiving portion) at one longitudinal end portion of the cylinder 1*a*. The coupling member 1*c* is made of a resin material such as polyacetal, polybarbonate, polyamide, polybutylene terephthalate, and has at the center thereof a substantially triangular-prism-like twisted projection 1*d*. On the other hand, a gear 9 which receives a rotational driving force from an unshown motor is provided in the main assembly of the image forming apparatus. The gear 9 has at the center thereof a substantially triangular shape twisted hole 9*a*.

When the gear 9 is rotated with the projection 1*d* and the hole 9*a* engaged with each other, the rotation of the gear 9 is transmitted to the photosensitive drum 1 with the projection Id being retracted toward the hole 9*a*, that is, in the photosensitive drum 1 being urged to the driving side (gear 9 side). As seen from the photosensitive drum 1, the direction of twisting of the projection 1*d* is opposite from the rotational direction A of the photosensitive drum 1 toward the free end of the projection 1*d* from the base portion, and the direction of twisting of the hole 9*a* is opposite toward the inside from the entrance opening of the hole 9*a*.

In this embodiment, the projection Id has a triangular-prism-like configuration, but this is not limiting, and another polygonal-prism-like configuration is usable. In such a case, the hole 9*a* has a corresponding polygonal-prism-like configuration.

Figure 3:
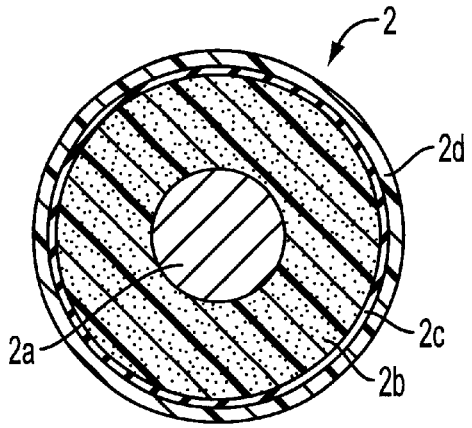
FIG. 3 is a section view of a charging roller according to an embodiment of the present invention.
Figure 4:
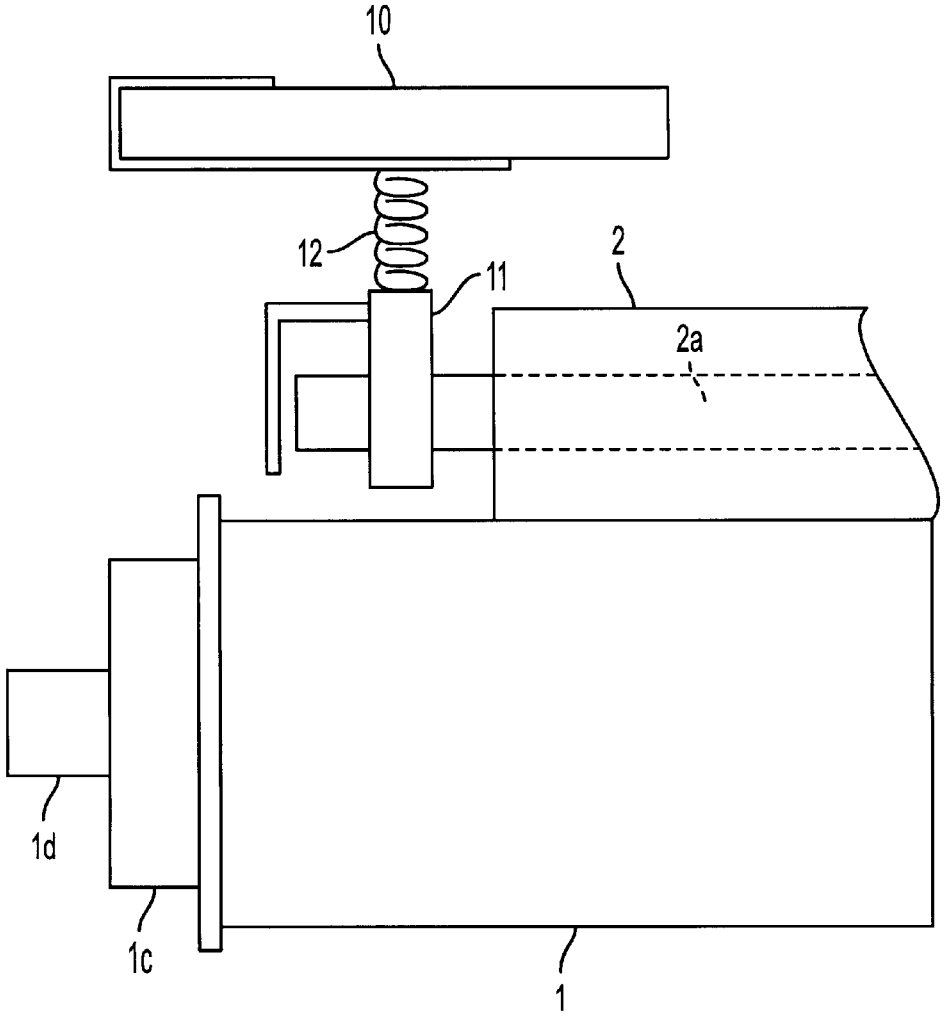
FIG. 4 is an illustration of a longitudinal end portion of the charging roller shown in FIG. 3.

Referring to FIG. 3 and FIG. 4, the charging roller 2 of this embodiment will be described.

In FIG. 3, the charging roller 2 comprises an electroconductive metal core 2*a* made of SUS or the like, an elastic layer 2*b* on the outer surface thereof, and a tube on the outer surface, the tube including a resistance layer 2*c* and a protection layer 2*d*. The outer diameter thereof is 12 mm. There is no so-called bonding layer between the elastic layer 2*b* and the resistance layer 2*c*.

The elastic layer 2*b* is made of EPDM sponge in which carbon or the like is dispersed so that charging roller 2 properly contacts the surface of the photosensitive drum 1. The resistance layer 2*c* formed on the outer surface thereof is made of urethane rubber in which carbon or the like is dispersed. Even if the surface of the photosensitive drum 1 has a pin hole, the leak current therethrough is suppressed, thus preventing an abrupt drop of the voltage. The protection layer 2*d* formed on the outer surface thereof is made of methylmethoxy Nylon in which carbon or the like is dispersed, and it functions to prevent deposition and alternation of the composition materials of the elastic layer 2*b* and the resistance layer 2*c* on the surface of the photosensitive drum 1.

As shown in FIG. 4, the charging roller 2 is supported by a bearing 11 at each of the opposite end portions of the metal core 2*a* penetrating the center of the charging roller 2. Between the bearing 11 and the process cartridge 10, a spring 12 is compressed at each of the bearings 11, so that the charging roller 2 is urged toward the photosensitive drum 1 so as to be in contact with the photosensitive drum 1 with a predetermined pressure. The charging roller 2 is not driven by a positive driving means, but is driven by rotation of the photosensitive drum 1.

Figure 5:
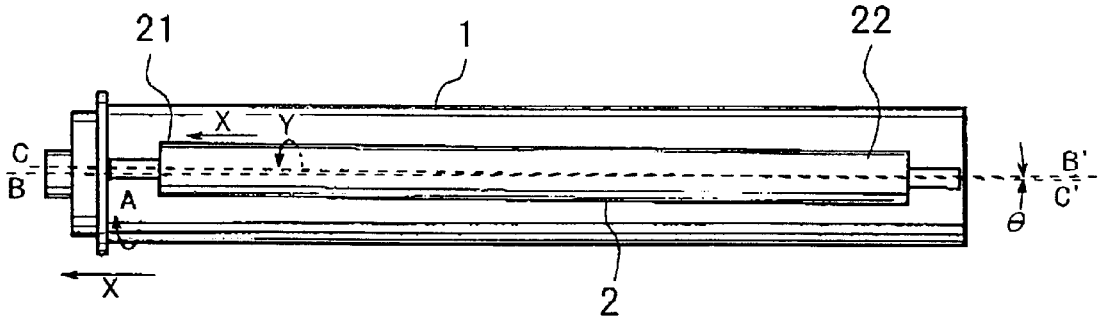
FIG. 5 is a top plan view illustrating a positional relationship between the photosensitive drum and the, charging roller according to an embodiment of the present invention.

Referring to FIG. 5, a description will be provided as to a crossing angle between the photosensitive drum 1 and the charging roller 2. FIG. 5 is a plan view of the photosensitive drum 1 and the charging roller 2 as seen from the top side of the charging roller 2.

As described in the foregoing, the photosensitive drum 1 is driven by the main assembly gear 9, by which it is rotated in the direction indicated by an arrow A about the rotation shaft (center line of rotation) B—B, during which it moves toward the driving side (gear side), that is, in the direction indicated by an arrow X to a predetermined position, and it continues rotating. A rotation shaft (center line of rotation) C—C of the charging roller 2 contacting the photosensitive drum 1 is inclined by a crossing angle/θ=0.25° from the rotation shaft B—B of the photosensitive drum 1, and the direction of the inclination is such that as seen from the top side of the charging roller 2, an end 21 of the charging roller 2 at the driving side of the photosensitive drum 1 is downstream of an end 22 of the charging roller 2 at a non-driving side of the photosensitive drum 1 with respect to the direction of the peripheral movement of the surface of the photosensitive drum 1. With this arrangement, when the photosensitive drum 1 is rotated, the charging roller 2 rotated in the direction indicated by an arrow Y by the rotation of the photosensitive drum 1 moves in the direction of arrow X, that is, toward the driving side of the driving photosensitive drum 1, similarly to the photosensitive drum 1.

Figure 6:
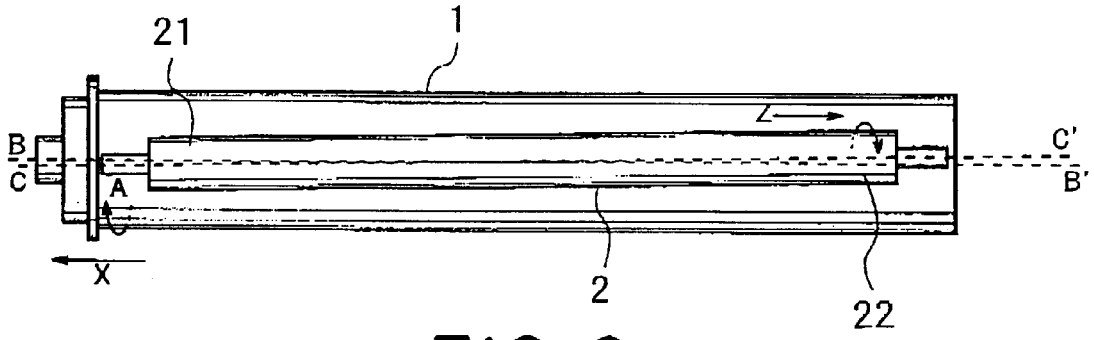
FIG. 6 is a top plan view illustrating a comparison example relative to the embodiment shown in FIG. 5.

A comparison will be made of a time period required for the charging roller 2 to reach the predetermined position in the longitudinal direction between a case (1) in which the moving direction of the charging roller 2 is the same as the moving direction of the photosensitive drum 1 by the rotation thereof, as in the above-described case, and (2) the moving direction of the charging roller 2 (arrow Z direction) is the opposite from the moving direction of the photosensitive drum 1. The experimental results are shown in Table 1. As for the latter case, use is made of a process cartridge in which, as shown in FIG. 6, as seen from the top side of the charging roller 2, the end 21 of the charging roller 2 at the driving side of the photosensitive drum 1 is upstream of the end 22 of the charging roller 2 at the non-driving side of the photosensitive drum 1 with respect to the peripheral movement of the photosensitive drum 1, and the absolute values of the crossing angle θ are 0.1° and 0.4° in consideration of the upper and lower limit of the tolerance.

TABLE 1

| | Crossing angle θ | |
|---|---|---|
| | 0.1° | 0.4° |
| Same direction | 3 sec | 2 sec |
| Opposite direction | 15 sec | 8 sec |

If the crossing angle θ is too large, an end surface of the bearing 11 which is contacted by the end surface of the metal core 2*a* when the charging roller 2 moves, tends to be scraped, and therefore, too large an angle is not preferable. The initial positions of the photosensitive drums of the two cases in the longitudinal directions, are substantially at the centers, and the initial positions of the charging rollers of the two cases are such that they contact the end surfaces of the bearing 11 at the sides opposite from the moving direction. The distances through which the charging rollers 2 move were about 3 mm.

In either of the cases, the photosensitive drum 1 is instantaneously moved to the driving side. In the case that the photosensitive drum 1 and the charging roller 2 moves in the same direction, the charging roller 2 is moved to the predetermined position instantaneously and automatically. On the other hand, in the case that the photosensitive drum 1 and the charging roller 2 move in opposite directions, a quite long time is required for the charging roller 2 to move to the predetermined position even if the crossing angle θ was large.

This means that there is a probability that the charging roller 2 does not yet reach the predetermined position before the image forming process starts in response to the instructions from the host computer. If this happens, fog production and/or sheet-edge contamination occurs due to the improper charging in the neighborhood of the lateral end of the recording material. Additionally, with the latter case, when a half-tone image was produced, a thin black stripe image was produced extending in an inclined direction, but stripe was partial. When the surface of the charging roller 2 with which the strip was produced, was observed, fine damage and waving were found on the surface.

As described in the foregoing, by making the peripheral moving direction of the photosensitive drum 1 produced by the rotation thereof the same as the peripheral moving direction of the charging roller 2, the photosensitive drum 1 and the charging roller 2 can be moved to the predetermined position automatically and instantaneously with certainty. Therefore, charging non-uniformity or the like, attributable to the improper charging at the longitudinal end portions, damage to the surface of the charging roller 2, waving, elongation and the like, can be reduced. Thus, the quality of the image forming apparatus is remarkably improved, and the operation thereof is stabilized, without a significant increase of cost and without a size-increase of the apparatus.

By moving the drum 1 and the charging roller 2 to one longitudinal end of the drum, the length of the drum 1 and the length of the charging roller 2 can be reduced. In this embodiment, the drive transmitting member is constituted by a projection 1*d* provided on the coupling member 1*c* at the end of the photosensitive drum 1 and a hole 9*a* formed in the gear 9 provided inside the image forming apparatus. However, the projection 1*d* and the hole 9*a* are provided in different members.

In this embodiment, a description has been provided with respect to a process cartridge 10 having the photosensitive drum 1 and the charging roller 2 as a unit, but the present invention is applicable when they are separate members.

Embodiment 2

Figure 7:
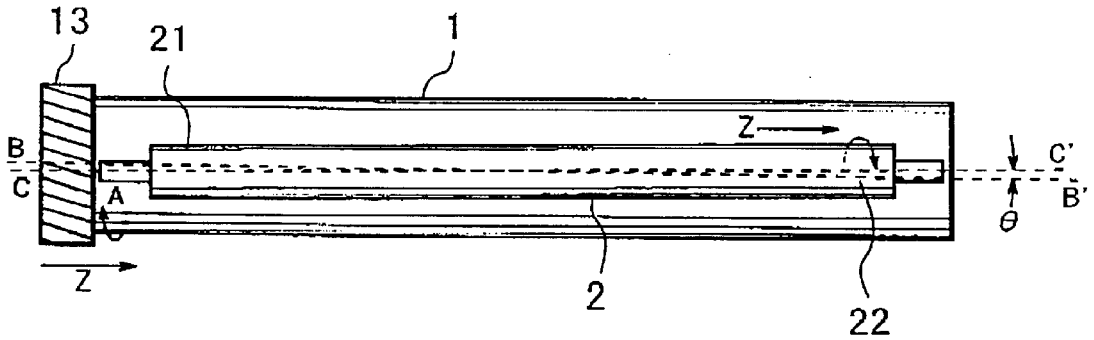
FIG. 7 is a top plan view illustrating a positional relation between the photosensitive drum and the charging roller according to another embodiment of the present invention.
Figure 8:
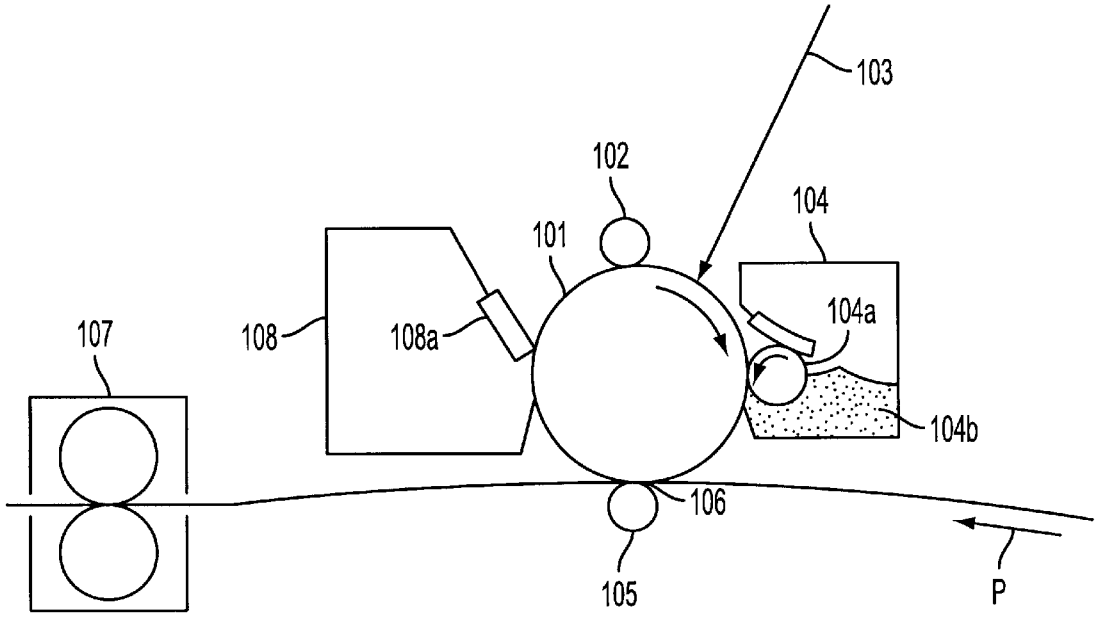
FIG. 8 PRIOR ART
FIG. 8 shows an example of a conventional image forming apparatus.

Referring to FIG. 7, the second embodiment will be described. In this embodiment, the same reference numerals as with the first embodiment are assigned to the elements having the corresponding functions.

In this embodiment, in place of the coupling member 1*c* of first embodiment, a helical gear 13 (driving force receiving portion) is fixed to one end portion of the photosensitive drum 1 by crimping. Correspondingly, the main assembly of the image forming apparatus is provided with a main assembly helical gear, which is driven by an unshown motor. When the driving force is transmitted from the main assembly helical gear to the helical gear 13, a thrust force is produced in such a direction that the photosensitive drum 1 is moved toward the non-driving side, that is, in the direction indicated by an arrow Z.

There is provided a crossing angle between the photosensitive drum 1 and the charging roller 2. More particularly, a crossing angle θ=0.25° is provided between the rotation shaft B—B of the photosensitive drum 1 and the rotation shaft C—C of the charging roller 2 contacting the photosensitive drum 1. The direction of the inclinations is such that, as seen from the top side of the charging roller 2, an end 21 of the charging roller 2 disposed at a driving side of the photosensitive drum 1 is an upstream side of the end 22 of the charging roller 2 disposed at the nondriving side of the photosensitive drum 1 with respect to the rotational direction of the photosensitive drum 1. By doing so, with a rotation of the photosensitive drum 1, the charging roller 2 driven thereby moves toward the non-driving side of the photosensitive drum 1, similarly to the photosensitive drum 1.

As described in the foregoing, with the above-described structure, the moving direction of the photosensitive drum and the moving direction of the charging roller 2 are codirectional. Similarly to the first embodiment, the photosensitive drum 1 and the charging roller 2 can be moved automatically and instantaneously to the predetermined position with certainty. Therefore, charging non-uniformity or the like attributable to the improper charging at the longitudinal end portions, the damage of the surface of the charging roller 2, waving, elongation and the like, can be reduced. Thus, the quality of the image forming apparatus is remarkably improved, and the operation thereof is stabilized, without a significant increase of cost and without a size-increase of the apparatus.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

a rotatable member to be charged;

a rotatable charge member for electrically charging said member to be charged, said charge member being contactable to said member to be charged; and moving means for moving said member to be charged and said charge member in a longitudinal direction of said member to be charged.

2. An apparatus according to claim 1, wherein said charge member is moved in the longitudinal direction by rotation of said member to be charged.

3. An apparatus according to claim 1, wherein said charge member is rotated by rotation of said member to be charged, said charge member has an axis of rotation which crossed with an axis of rotation of said member to be charged.

4. An apparatus according to claim 1, 2 or 3, wherein said moving means includes a driving force receiving portion for receiving a driving force for rotating said member to be charged, and said member to be charged is moved in the longitudinal direction by the driving force.

5. An apparatus according to claim 4, wherein said driving force receiving portion is disposed at an end of said member to be charged with respect to the longitudinal direction, and said driving force receiving portion includes a projection in the form of a twisted polygonal prism engageable with a twisted polygonal hole.

6. An apparatus according to claim 4, wherein said driving force receiving portion is disposed at an end of said member to be charged with respect to the longitudinal direction, and said driving force receiving portion includes a twisted polygonal hole engageable with a projection in the form of a twisted polygonal prism.

7. An apparatus according to claim 4, wherein said driving force receiving portion is disposed at an end of said member to be charged with respect to the longitudinal direction, and said driving force receiving portion is provided with a helical gear.

8. An apparatus according to claim 1, wherein said member to be charged is in the form of a drum.

9. An apparatus according to claim 1, wherein said charge member is in the form of a roller.

10. An apparatus according to claim 9, wherein said member to be charged is an image bearing member for bearing an image.

11. A process cartridge detachably mountable to a main assembly of an image forming apparatus, said process cartridge comprising:

a rotatable member to be charged;

a rotatable charge member for electrically charging said member to be charged, said charge member being contactable to said member to be charged; and a moving force receiving portion for receiving a moving force from the main assembly of the apparatus in such a direction as to move said member to be charged and said charge member in a longitudinal direction of said member to be charged.

12. A process cartridge according to claim 11, wherein said charge member is moved in the longitudinal direction by rotation of said member to be charged.

13. A process cartridge according to claim 11, wherein said charge member is rotated by rotation of said member to be charged, and wherein said charge member has an axis of rotation which crosses an axis of rotation of said member to be charged.

14. A process cartridge according to any one of claim 11, 12 and 13, wherein said moving force receiving portion includes a driving force receiving portion for receiving a driving force for rotating said member to be charged, and said member to be charged is moved in the longitudinal direction by the driving force.

15. A process cartridge according to claim 14, wherein said driving force receiving portion is disposed at an end of said member to be charged with respect to the longitudinal direction, and said driving force receiving portion includes a projection in the form of a twisted polygonal prism engageable with a twisted polygonal hole.

16. A process cartridge according to claim 14, wherein said driving force receiving portion is disposed at an end of said charge member with respect to the longitudinal direction, and said driving force receiving portion includes a twisted polygonal hole engageable with a projection in the form of a twisted polygonal prism.

17. A process cartridge according to claim 14, wherein said driving force receiving portion is disposed at an end of said member to be charged with respect to the longitudinal direction, and said driving force receiving portion is provided with a helical gear.

18. A process cartridge according to claim 11, wherein said member to be charged is in the form of a drum.

19. A process cartridge according to claim 11, wherein said charge member is in the form of a roller.

20. A process cartridge according to claim 11, wherein said member to be charged is an image bearing member for bearing an image.

21. A process cartridge according to claim 20, wherein said image bearing member is a photosensitive member.

* * * * *

UNITED STATES PATENT AND TRADEMARK OFFICE

CERTIFICATE OF CORRECTION

PATENT NO. : 6,600,886 B2
DATED : July 29, 2003
INVENTOR(S) : Shinichi Tsukida et al.

It is certified that error appears in the above-identified patent and that said Letters Patent is hereby corrected as shown below:

Column 3,
Line 49, “the,” should read -- the --.

Column 5,
Lines 21 and 29, “Id” should read -- 1d --.

Column 6,
Line 13, “angle/θ=0.25º” should read -- angle θ=0.25º --.

Column 7,
Line 1, “moves” should read -- move --.
Line 19, “strip” should read -- stripe --.

Signed and Sealed this

Third Day of February, 2004

JON W. DUDAS
*Acting Director of the United States Patent and Trademark Office*